US007049901B2

(12) United States Patent
Sacco

(10) Patent No.: US 7,049,901 B2
(45) Date of Patent: May 23, 2006

(54) PARALLEL PLATE WAVE-GUIDE STRUCTURE IN A LAYERED MEDIUM FOR TRANSMITTING COMPLEMENTARY SIGNALS

(75) Inventor: Andrew P. Sacco, Pittsford, NY (US)

(73) Assignee: ITT Manufacturing Enterprises Inc., Wilmington, DE (US)

( * ) Notice: Subject to any disclaimer, the term of this patent is extended or adjusted under 35 U.S.C. 154(b) by 137 days.

(21) Appl. No.: 10/316,139

(22) Filed: Dec. 10, 2002

(65) Prior Publication Data

US 2004/0108921 A1 Jun. 10, 2004

(51) Int. Cl.
*H01P 3/02* (2006.01)

(52) U.S. Cl. ..... 333/4; 333/5

(58) Field of Classification Search ..... 333/1, 333/4, 5; 174/27, 36
See application file for complete search history.

(56) References Cited

U.S. PATENT DOCUMENTS

| | | | | |
|---|---|---|---|---|
| 758,598 | A * | 4/1904 | Richmond | 333/243 |
| 4,845,311 | A * | 7/1989 | Schreiber et al. | 333/1 X |
| 5,027,088 | A * | 6/1991 | Shimizu et al. | 333/1 |
| 5,334,800 | A * | 8/1994 | Kenney | 174/35 R |
| 5,418,504 | A * | 5/1995 | Nottenburg | 333/1 |
| 5,539,360 | A * | 7/1996 | Vannatta et al. | 333/4 |
| 6,677,832 | B1 * | 1/2004 | Guinn et al. | 333/116 |

OTHER PUBLICATIONS

I. J. Bahl and P. Bhartia, "The Design of Broadside-Coupled Stripline Circuits," IEEE Transactions on Microwave Theory and Techniques, vol. MTT-29, No. 2, Feb. 1981, pp. 165-168.

David K. Cheng, "Field and Wave Electromagnetics," Addison-wesley, Nov. 1992. pp. 429-470 and 547-559.

Brian C. Wadell, "Transmission Line Design Handbook," 1991 Artech House, Inc., pp. 1-9, 222-239, and 433-451.

Seymour B. Cohn, "Characteristic Impedances of Broadside-Coupled Strip Transmission Lines," IRE Trans. On Microwave Theory and Techniques, vol. MTT-8, pp. 633-637, Nov. 1960.

J. Paul Shelton, Jr., "Impedances of Offset Parallel-Coupled Strip Transmission Lines," IEEE Transaction on Microwave Theory and Techniques, vol. MTT-14, No. 1, Jan. 1966, pp. 7-15.

* cited by examiner

*Primary Examiner*—Benny Lee
(74) *Attorney, Agent, or Firm*—RatnerPrestia

(57) ABSTRACT

A parallel plate wave-guide structure in a layered flexible/formable medium for transmitting complementary signals, including: at least two parallel signal conductor plates, placed in substantially close proximity, separated by a conductor-to-conductor dielectric material, and having a controlled impedance contained between the at least two parallel complementary signal conductor plates dominated by odd mode propagation of transverse wave components between the at least two parallel complementary signal conductor plates; at least two parallel reference plates forming a parallel plate reference system parallel to and surrounding the at least two parallel complementary signal conductor plates; dielectric materials that are contained between each of the at least two parallel complementary signal conductor plates and a corresponding parallel reference plate; a partial rectangular wave-guide structure comprised of the parallel plate reference system, such that each of the at least two parallel reference plates are electrically interconnected periodically.

18 Claims, 5 Drawing Sheets

$$Z_3 < \frac{1}{\frac{1}{Z_1} + \frac{1}{Z_2}}$$

PARALLEL PLATE WAVE-GUIDE STRUCTURE IN A LAYERED MEDIUM FOR TRANSMITTING COMPLEMENTARY SIGNALS

FIELD OF THE INVENTION

The invention relates generally to the field of signal transmission, and in particular to signal transmission for high frequency broadband circuitry. More specifically, the invention relates to a wave-guide structure that propagates signals between multiple parallel plates.

BACKGROUND OF THE INVENTION

The demand for broadband information access increases every year. Spurred on by the desire for ever higher resolution in digital imaging, higher data access speeds, and corporate incentives to increase revenue streams, many inventors have attempted to improve the efficiency of high bandwidth wired information handling systems. Infoimaging has been estimated to be a $385 billion-plus industry that converges image science and information technology. Infoimaging has three inter-related segments: a) devices; b) infrastructure; and c) services and media.

Charged couple devices (CCDs) are known efficient collectors of image data. In order to collect higher resolution image data, at ever higher rates such as that found in today's broadband access networks from CCD imagery, one needs higher register clocking speeds.

Nearly square clocking waveforms are needed to drive the CCDs' transfer registers to shift out image data efficiently. Using standard timing waveform techniques is unacceptable, because the CCDs' transfer register load is extremely large and reactive. Most two-phase register CCDs resemble a distributed load or a transmission line. Therefore, a conventional timing waveform would have difficulty maintaining signal integrity, waveshape, and voltage amplitude, without carefully controlled signal conditioning. The CCDs' registers cannot withstand voltage losses. Their efficiency is greatly dependent on the wave-shape and peak voltage values.

To successfully operate a CCD running at high speeds, the high capacitance of the transfer registers should, preferably, be accommodated.

Although a driving signal is often referred to as a clock and is very similar to a TTL or CMOS digital waveform employed in high bandwidth data handling systems, the driving signal's necessary low characteristic impedance has more demanding requirements. Due to the nature of a transfer register's non-symmetric high capacitive distributed load, high power transfer and low voltage distortion are critical to achieving acceptable charge transfer efficiencies. Employing conventional transmission line techniques from the engineering literature is problematic, as the characteristic impedance for the driving signal becomes much lower than what might be considered the industry standard.

Standard transmission line techniques are conventionally considered for matching the CCD transfer registers' impedance, because of the CCD's input impedance resemblance to an actual transmission line. Three of the most popular transmission line options for high speed wired data transfer systems employ coaxial, twisted pair or fiber optic transmission lines. The vast majority of transmission line usage for Radio Frequency (RF) electrical signals is centered around 50 Ohms for military and industrial systems, or 75 Ohms for commercial cable systems. In engineering literature, many equations for generating transmission line geometry utilize the 50–75 Ohm impedance range as a de-facto standard. However, the equations are often simplified to the point where they do not have a valid solution should the operating impedance deviate from 50 Ohms by more than a factor of ten.

Standard system design techniques tend to assume certain parameters, including: a 50 Ohm system; a matched load; a modest amount of distortion; and that a few decibels (dB) of power loss in the transmission (cable) medium is acceptable. These assumptions are not accurate for two-phase CCD transfer registers. To compensate, designers have typically placed driver circuitry as close to the CCD, as necessary, to avoid any path effects. As speeds increase, short path lengths begin to demonstrate transmission path issues. However, often the driving circuitry and the CCD have different impedance characteristics; and conventional reactive matching techniques do not have the bandwidth to accommodate a large range of operating frequencies.

Another conventional transmission line approach for driving the CCD transfer registers uses a differential signaling technique found in twisted pair technology. Twisted pairs or balanced line systems generally employ differential mode signal propagation. A common format for differential signaling is known as low-voltage-differential-signaling (LVDS). LVDS is a popular method for high-speed data transfer applications. With data transfer as its primary goal, its transmission line structure is centered on a balanced low noise, large bandwidth digital signaling geometry. With LVDS, the source impedance is typically much higher than the line impedance to eliminate common mode ringing. This technique provides digital waveform fidelity with reduced signal amplitude and power transfer. The common design impedance range is between 50 and 150-Ohm differential line and between 50 and 75 Ohm single-ended line. The two-phase CCD register requires waveform fidelity in addition to maintaining signal amplitude into a highly reactive load. Also, increased power transmission efficiency is important to maintaining the integrity of the signal shape at impedance values much lower than 50 Ohms.

Notably, because power transfer is reduced and is not the primary goal of an LVDS implementation, LVDS is not suitable for complementary register clocking. Transmission lines for two-phase CCD clocks have the added necessity of transferring power efficiently without distortion to, what is typically, a non-symmetric, highly capacitive load.

Accordingly, there is a need in the art to provide a transmission structure with the properties of high power transfer, low distortion, and low radiation efficiency to drive high speed complementary circuits, such as two phase CCD transfer registers, while maximizing bandwidth and having a minimum of impedance matching losses.

SUMMARY OF THE INVENTION

The present invention is directed to overcoming one or more of the problems set forth above by providing a parallel plate wave-guide structure in a layered flexible/formable medium for transmitting complementary signals, that includes: a) at least two parallel broadside coupled plates having a controlled impedance contained between the at least two parallel plates that emphasizes propagation of Transverse Electro-Magnetic (TEM), Transverse Electric (TE) and Transverse Magnetic (TM) wave modes between the at least two parallel plates; b) a parallel plate reference system surrounding the at least two parallel broadside coupled plates that provide a controlled impedance in relation to the reference system and the at least two broadside coupled parallel plates; c) at least two, independent controlled impedance paths contained by each of the at least two parallel broad side coupled plates and the corresponding parallel reference plate creating at least two independently controlled paths, within the reference system, and that appear outside of either of the at least two broadside coupled parallel plates; and d) a partial rectangular wave-guide comprised of the parallel plate reference system, such that each of the at least two parallel plates of the reference system are electrically interconnected periodically forming a rectangular geometry.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

Two primary goals are met by the present invention: (i) transferring high bandwidth power efficiently, without distortion, between a source and a load at relatively high speeds; and, (ii) compensating for a non-symmetric distributed load. A parallel plate wave-guide structure takes advantage of the fact that two-phase register clocks are complementary in nature, thus, making complementary signaling using the odd modes of propagation in the parallel-plate structure most efficient. For this application herein, the odd mode of propagation refers to the odd components of either the Transverse Electric (TE) or Transverse Magnetic (TM) wave. These odd components, are the dominant components, making them the most critical modes for matching the line to the load. The even mode impedance becomes very high and is typically not critical. Consequently, the even mode impedance is matched on the source side with a series loading impedance to reduce common mode ringing. Two independently controlled single ended propagation paths are used to accommodate a non-symmetric portion of a load in such a way as to provide an efficient path within a shielded parallel plate wave-guide structure between each of the parallel signal conductor plates and its adjacent parallel reference plate. All the image currents resulting from the non-symmetric load remain within the parallel plate wave-guide structure, therein providing extremely low radiation efficiency. Each of the two independently controlled single ended paths will have a different characteristic impedance value, thus a different series loading resistance value.

Figure 1:
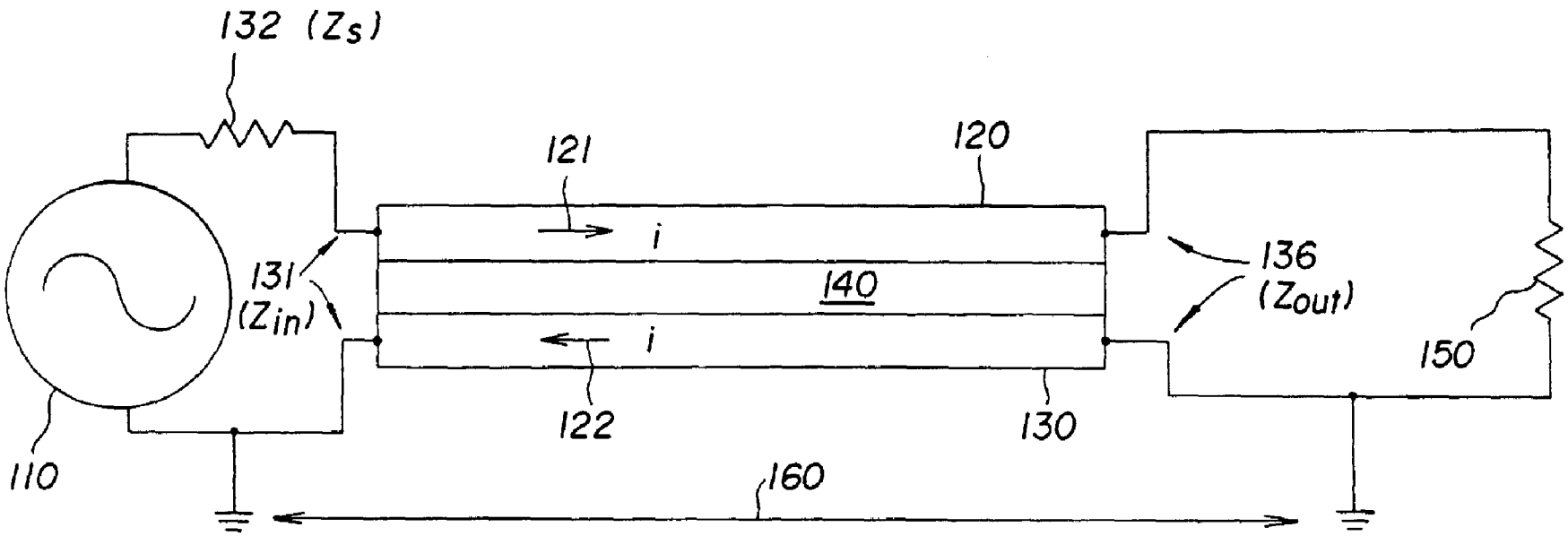
Fig. 1 PRIOR ART
FIG. 1 is a schematic of prior art stripline type transmission line.

The present invention accommodates high frequency, wide bandwidth complementary signals with large peak currents. FIG. 1 discloses an ideal case for a prior art usage of a stripline transmission line. The drive signal 110 is connected to the load by signal conductor plates 120 and 130. The signal conductor plates 120 and 130 are positioned in a parallel stack-up with a dielectric 140 in between the signal conductor plates 120 and 130. This geometry provides a controlled impedance structure within which energy can propagate. The drive current 121 in signal conductor plate 120 will induce an image current 122 in reference conductor plate 130. For the ideal propagation case, if all of the electric field lines are controlled between the conductor plates 120 and 130, the magnetic field induces an image current 122 only in the reference conductor plate 130, directly beneath the drive current path 121. If the load impedance 150 is not equal to the source 110, a matching technique must be employed to maximize power transfer and minimize standing waves. This matching technique sets the transmission line impedance 136 ($Z_{out}$) to be equal to the load impedance 150, when providing a series loading resistor 132 ($Z_s$) to resistively match impedances between the source 110 and the transmission line 131 ($Z_{in}$). If the transmission line 131 is properly matched, a majority of the energy propagates between conductor plates 120 and 130 and no image currents 122 flow in the chassis return 160.

Figure 2:
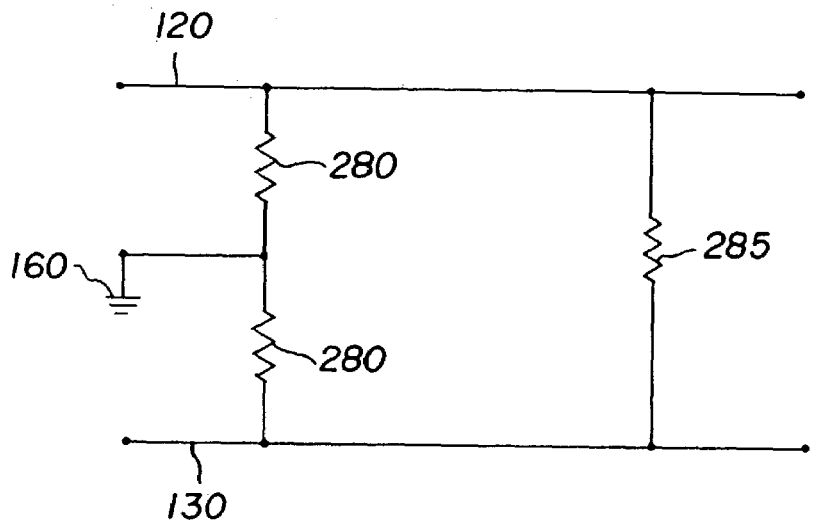
Fig. 2 PRIOR ART
FIG. 2 shows the characteristic impedance relationship of the prior art stripline in FIG. 1.

FIG. 2 shows an electrical schematic, using electrical symbols, and provides the characteristic impedance relationship for the prior art implementation of FIG. 1. This impedance relationship, is depicted as a shunt impedance 280 between a first signal conductor plate 120 and a chassis return 160 that equals a shunt impedance 280 between a second conductor plate 130 and the chassis return 160. A differential impedance 285 between first and second conductor plates 120, 130, respectively, can be expressed as $Z1<Z2\leqq(2*Z1)$.

The characteristic or composite impedance 136 for the transmission line shown in FIG. 1 is the geometric mean of the odd and even modes of propagation according to the following equation:

$$Z_{composite}=\sqrt{Z_o*Z_e} \qquad \text{Equation 1}$$

Figure 3:
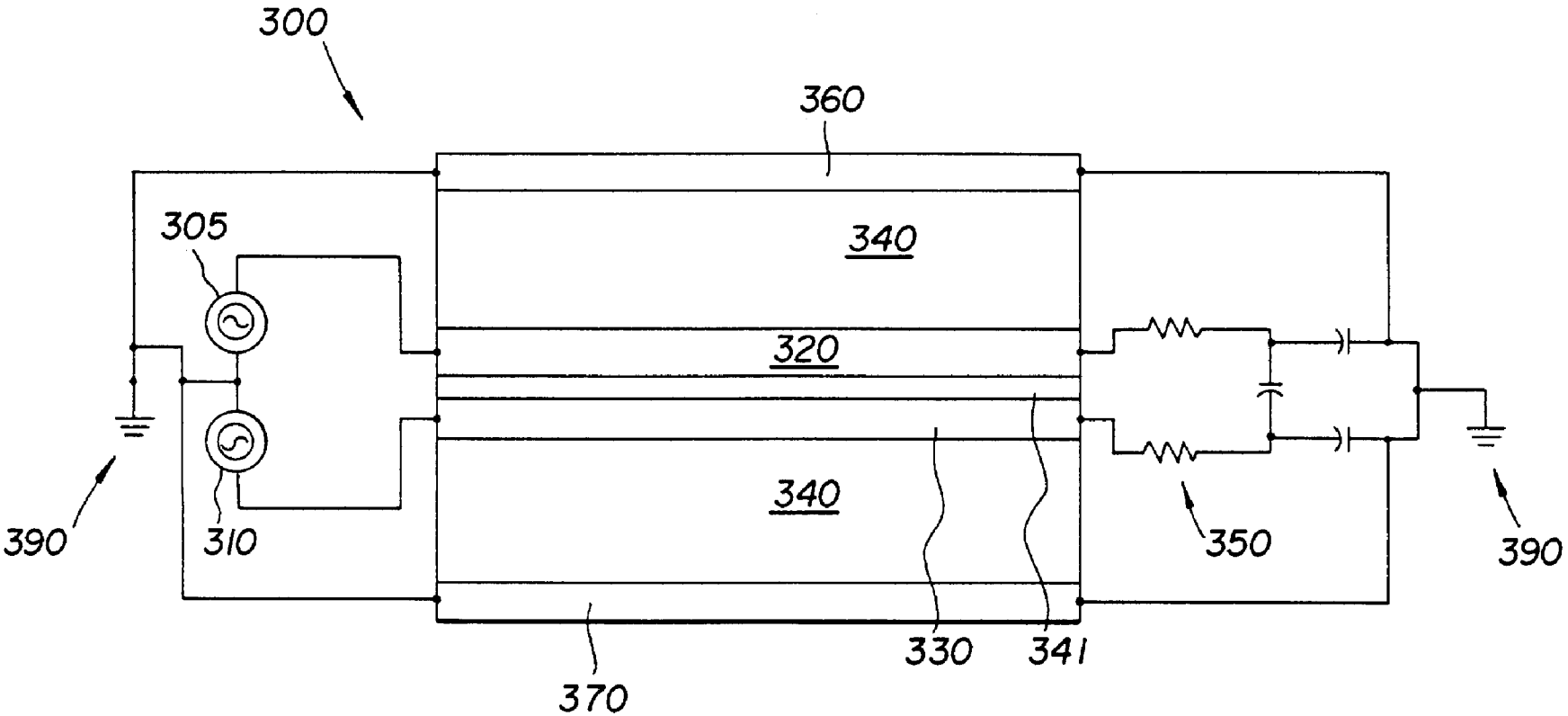
FIG. 3 is a schematic showing the shielded parallel plate transmission line geometry of the present invention.

Where: $Z_o$=Odd mode characteristic impedance, $Z_e$=Even mode characteristic impedance The present invention is based on an odd mode propagation characteristic that has an impedance which is much lower than a conventional 50 Ohm system. FIG. 3 illustrates a parallel plate wave-guide structure 300 and how parallel layers of signal conductors, reference conductors, and dielectric materials stack up to provide desirable impedance characteristics. The propagation impedance for the parallel plate wave-guide structure 300 is at least a factor of 10 lower than the even mode impedance characteristic. The parallel plate wave-guide structure 300 could be implemented with various conductive and dielectric materials bonded together, using adhesives with dielectric properties. For example, in a flexible medium like a flexible circuit card material, a common flexible Copper-Mylar material could be used. The length of the flexible circuit card material is strongly dependent upon acceptable signal losses. The flexible circuit transmission line may be several inches to many feet, and longer when using super-conducting materials. The parallel plate wave-guide structure 300 can use wire bonding and through-hole soldering for end launch connectivity to a source and a load. In one embodiment of the present invention, the load is a CCD two-phase transfer register that resides on a silicon substrate. The source is a complementary high current, high bandwidth power amplifier. Other examples of materials with similar conductive and dielectric properties are ceramic, silicon-based, or super-conductor based materials that may be fabricated into the parallel plate wave-guide structure 300. A controlled impedance, low loss path for energy to propagate is extremely preferable.

Complementary signal conductor plates 320, 330 are driven with complementary signal sources 305, 310, respectively, such that each provides the image current path for the other. In general, the image current is equal and opposite in direction to the source current, and the signal conductor plates 320, 330 contain each other's image current. Consequently, the signal conductor plates 320, 330 are considered complementary to each other. The signal conductor plates 320, 330 are placed close together such that the coupling between the plates favors odd mode propagation. However, a conductor-to-conductor dielectric material 341 separates the signal conductor plates 320, 330. One should also note that conductor-to-conductor dielectric material 341 can be composed of materials such as: gases, polymers, ceramics, liquids, and silicon substrates, especially where the material has low dielectric losses and high resistivity.

As the dominant mode of propagation for complementary signals, the odd mode impedance, $Z_o$, is designed to match the odd mode impedance characteristic of a load 350. A possible model for the load 350 is a balanced distributed load represented by lumped elements. In the ideal case, no image current flows in reference plates 360, 370 or in the chassis return 390. Again, in an ideal case, the chassis return 390 is not required as an electrical connection. Due to the non-symmetry of the load, all the image currents do not flow in the opposite parallel plate. Those image currents that do not flow in the opposite parallel plate also require a controlled impedance path or paths within the structure in order to maintain signal integrity and reduce radiation efficiency. In this implementation these paths will have different impedance values due to the non-symmetry in the load.

The first signal plate 320 and the first reference plate 360 provide a signal propagation path identical in length to the signal path formed by the second plate 330 and the second reference plate 370. The multiple paths available to the signal formed by the complementary signal plates 320 and 330, the first signal plate 320 with the first reference plate 360 and the second signal plate 330 with the second reference plate 370 provide three distinct paths for additional components of the signal to propagate, thus enhancing propagation efficiency, power transfer and reducing signal distortion.

Figure 4:
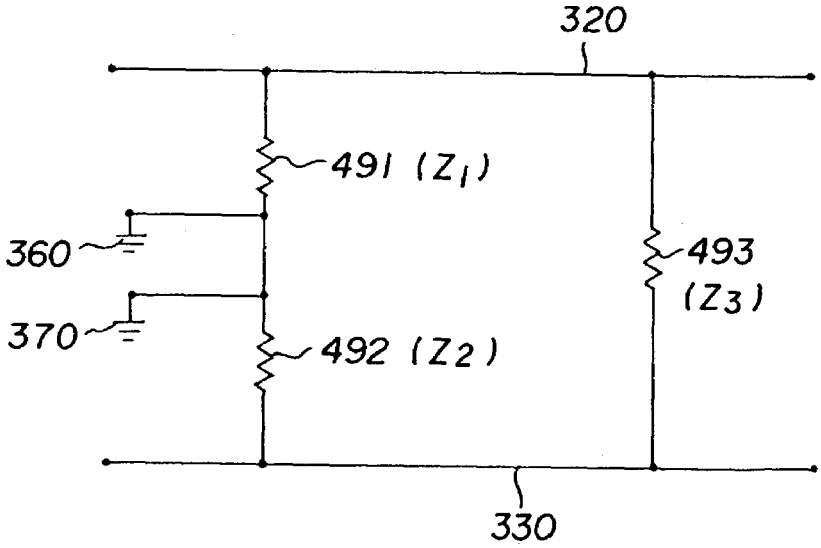
FIG. 4 shows the characteristic impedance relationship of the conductor plates in FIG. 3.

FIG. 4 shows an electrical schematic, using electrical symbols, that provides the characteristic impedance relationship for the implementation of FIG. 3. An unequal impedance relationship, for FIG. 3, is depicted as a shunt impedance 491 between a first signal conductor plate 320 and a first reference plate 360. Shunt impedance 491 ($Z_1$) does not necessarily equal a shunt impedance 492 ($Z_2$) between a second signal conductor plate 330 and a reference plate 370. In FIG. 4, a controlled impedance 493 ($Z_3$) is shown between complementary first and second signal conductor plates 320, 330. The controlled impedance 493, as shown in FIG. 4, has a characteristic impedance relationship inversely proportional to the shunt impedances 491 and 492.

Again referring to FIG. 3, the thicknesses and/or widths of the signal conductor plates 320, 330 and the respective reference plates 360, 370 can be varied to provide different single-ended impedance characteristics, and be independent of the odd mode characteristic between the signal conductor plates 320,330.

Small thicknesses or material variations in the reference-to-conductor dielectric materials 340 and/or the widths of signal conductor plates 320, 330 will not significantly impact the odd mode characteristic impedance between the signal conductor plates 320, 330. One should also note that reference-to-conductor dielectric materials 340 can be composed of materials such as: gases, polymers, ceramics, liquids, and silicon substrates, especially where the material has low dielectric losses and high resistivity.

The single-ended values, Z1 and Z2, (shown in FIGS. 3 and 4 as shunt impedance 491, 492, respectively), are derived from thicknesses of the reference-to-conductor dielectric material 140. Using FIG. 1 as a model provides a close match for the single-ended portion of the load ($Z_3$) to the transmission line ($Z_1$ and $Z_2$ as shown in FIG. 4). As shown in FIG. 4. $Z_1$ (491) is the shunt impedance between plates 320 and 360, $Z_2$ (492) is the shunt impedance between plates 330 and 370, and $Z_3$ (493) is the impedance between plates 320 and 330. Moreover, $Z_3$ is less than the inverse of $$\left(\frac{1}{Z_1}+\frac{1}{Z_2}\right).$$

With the configuration shown in FIG. 3, the energy due to the non-symmetric load 350 is contained within the reference-to-conductor dielectric material 340, thus minimizing image current flow in the chassis return 390. The characteristic impedance relationship is shown in FIG. 4 and is expressed by the equation:

$$Z_{op}:=\left|\sqrt{\frac{(R_{dis}+\sqrt{-1}\cdot L\cdot 2\cdot f\pi)}{((G+\sqrt{-1}\cdot C\cdot 2\cdot f\cdot\pi))}}\right| \qquad \text{Equation 2}$$

The characteristic line impedance is normally derived as a function related to per unit length of the transmission line. Equation 2 represents the characteristic impedance of the parallel plate wave-guide structure 300 consisting of signal conductor plates 320, 330 and conductor-to-conductor dielectric material 341, as a function of unit length. In one embodiment of the present invention, conductor-to-conductor dielectric material 341 is an adhesive. In another embodiment, conductor-to-conductor dielectric material 341 may not be an adhesive, but may be a gas or a liquid. Where: $Z_{op}$ is the characteristic impedance, $R_{dis}$ is the series resistance per unit length, G is the shunt conductance per unit length, L is the series inductance per unit length, C is the shunt capacitance per unit length, and f is the fundamental frequency of operation. The odd mode portion of the characteristic impedance for the parallel signal conductors 320, 330, with the reference system including reference plates 360, 370, is found more rigorously by Equation 3:

$$Z_{oo}(k):=\left|\frac{296.1}{2\sqrt{\varepsilon_r}\,\dfrac{b\cdot\left[\frac{1}{2}\cdot\left(\ln\left(\frac{1-k}{1+k}\right)\right)\right]}{s}}\right| \qquad \text{Equation 3}$$

In Equation 3, $Z_{oo}(k)$ is the odd mode characteristic impedance for the structure found in FIG. 3; $\epsilon_r$=the dielectric constant for the dielectric materials 340, 341, b=the distance between the reference plates 360, 370; s=the distance between the signal conductors 320, 330; and k is the solution to the first order elliptic function that satisfies the following:

$$R(k) := \left[\frac{\left(k\frac{b}{s}-1\right)}{\left(\frac{1}{k}\frac{b}{s}-1\right)}\right]^{\frac{1}{2}} \quad \text{Equation 4}$$

Given:

$$\frac{w}{b}-\frac{1}{\pi}\cdot\left[\ln\left[\frac{1+R(k)}{1-R(k)}\right]-\frac{s}{b}\cdot\ln\left[\frac{\left(1+\frac{R(k)}{k}\right)}{\left(1-\frac{R(k)}{k}\right)}\right]\right]=0 \quad \text{Equation 5}$$

Where: w=trace width of signal conductors 320, 330.

By solving Equations 3, 4, and 5 such that the odd mode characteristic impedance of the conductors is equivalent to the odd mode (balanced) portion of the load impedance, and solving Equation 2 for the non-symmetric components of the load impedance between the signal conductors 320, 330 and the reference plates 360, 370, respectively, the stray image currents and the radiation efficiency are reduced beyond that of matching only the balanced portion of the load.

Figure 5:
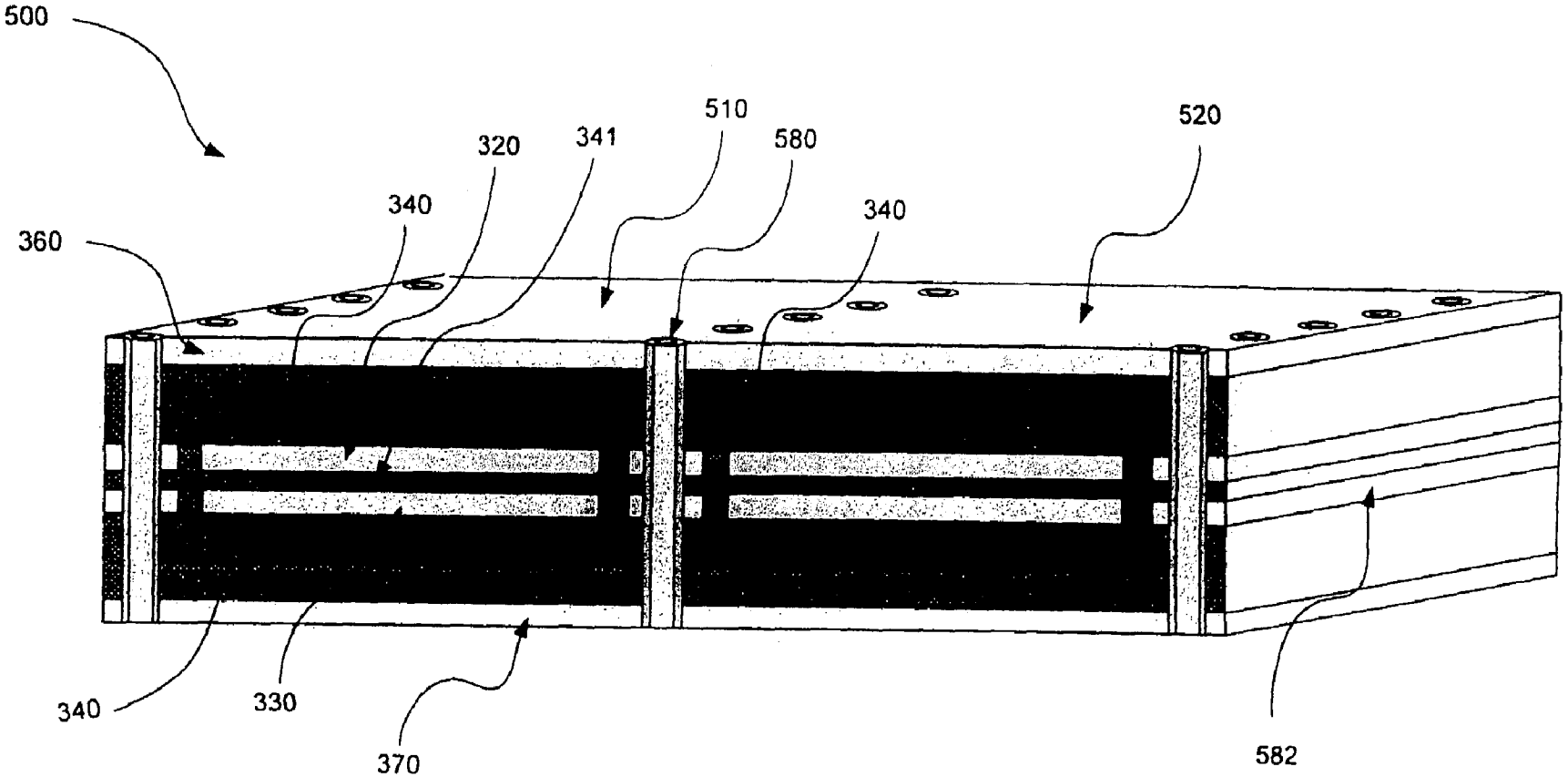
FIG. 5 shows a pictorial of the shielded broadside-coupled parallel plate wave-guide structure of the present invention and indicates conductor stack-up and via locations.

Further containment of image currents and stray fields is accomplished, in this embodiment of the invention, by fashioning the reference plates 360, 370 into a partial rectangular wave-guide with the addition of interconnecting vias 580 (see FIG. 5). The partial rectangular wave-guide includes a plurality of conductive parallel plates, such as reference plates 360, 370, and periodically connected together by conductive, interconnecting vias 580. At least two parallel plates, such as the signal conductor plates 320, 330, carry the complementary signal components contained within the partial rectangular wave-guide's reference system that includes the conductive parallel reference plates 360, 370 and interconnecting vias 580.

The geometry of a partial rectangular wave-guide structure 500, as shown in FIG. 5, is set up such that all the conductors, including signal conductors 320, 330 and reference plates 360, 370 follow the identical path length from the source to the load forming a rectangular structure. As a result, all wave components will propagate over the identical length of transmission line. The partial rectangular wave-guide structure 500 includes sections 510 and 520, and may have more sections as needed. The partial rectangular wave-guide structure 500 may be several inches in length and several tenths of inches in width, and be made of flexible circuit trace material. Since only TE and TM waves can be present in a rectangular wave-guide, TEM wave propagation will be considered negligible for the partial rectangular wave-guide structure 500. Also, as the ratio of wave-guide height to wave-guide width becomes smaller than ½, the higher order TE and TM modes are attenuated; and, if the cutoff frequency of the structures is much higher than the highest frequencies of the signal content, only the dominant mode $TE_{10}$ remains. Equation 6 is for the cutoff frequency $f_c$ in (Hz) for a rectangular wave-guide structure 500 when $TE_{10}$ is the dominant mode.

$$f_c := \frac{1}{2\cdot a\sqrt{\mu\cdot\varepsilon}} \quad \text{Equation 6}$$

Where:
a=wave-guide width
μ=permitivity of the dielectric material
ϵ=permeability of the dielectric material The attenuation constant (α)$TE_{10}$ in (Np/M) for the mode $TE_{10}$ is $$\alpha TM_{10} := \frac{1}{\eta\cdot b}\cdot\sqrt{\frac{\pi\cdot f\cdot\mu}{\sigma\cdot\left[1-\left(\frac{f_c}{f}\right)^2\right]}}\cdot\left[1+\frac{2\cdot b}{a}\left(\frac{f_c}{f}\right)^2\right] \quad \text{FIG. 7}$$

Where:
η=Intrinsic impedance of the dielectric
f=Highest signal component frequency
$f_c$=Cutoff frequency
σ=Conductivity of the dielectric
a=Wave-guide width
b=Wave-guide height
μ=Permeability of dielectric Once an attenuated mode $TE_{10}$ begins to dominate, the guide walls can be treated as a shield, effectively, separating internal fields from external ones. In this embodiment, the reference plates make up the wall's width dimension (b), and the interconnecting vias 580 make up the wall's dimension height (a). The interconnecting vias 580 make up only a partial wall with an effective resonant slot length. The radiation efficiency of the slot length is provided by Equation 8. By solving Equation 8 for a practical slot length, optimizing the b/a ratio with Equation 7 for attenuation, and Equation 6 for cutoff frequency, the radiation efficiency of the wave-guide is greatly reduced. The overall partial rectangular wave-guide structure 500 is comprised of the parallel signal conductor plates 320, 330 nested coaxially inside the partial rectangular wave-guide structure 500.

The improvements using this geometry include: maximized power transfer; reduced reflections; equalized delays; well-behaved fields; and broadband signal characteristics. The design utilizes a novel approach to combining at least two impedance paths within a structure to create an improved method for transmitting power in a non-ideal system. This approach satisfies both the complementary and non-symmetric characteristic of the load.

Beginning with the non-symmetric application, the design is accomplished by assuming each signal conductor 320, 330 in the parallel plate design is a single-ended micro-strip transmission line with respect to its adjacent reference plate 360, 370, capable of being terminated, properly, for the worst case single-ended load. Each of the signal conductors 320, 330 may not have the same single-ended impedance characteristic, thus a different conductor width or dielectric thickness. The parallel plate structure for signal conductors 320, 330 is assembled by placing the micro-strip structures back-to-back (i.e., driven plates) such that the driven plates are separated by a thin conductor-to-conductor dielectric material 341, and spaced according to the desired balanced odd mode impedance characteristic (see, for example, FIG. 2).

Referring to FIG. 5, once the plate and ground reference geometry are designed, the reference system can be connected to form a fourth independent path comprised of a partial rectangular wave-guide structure 500 by placing interconnecting vias 580 along the outer edge and between the reference plates 360 and 370. The interconnecting vias 580 are spaced to reduce the radiation efficiency as much as possible for the application and to maintain flexibility. This rigid or flexible/formable layered structure is descriptively referred to as a "flat, coaxial partial rectangular wave-guide." The partial rectangular wave-guide structure 500 will have properties that impact the attenuation of the higher order TE and TM modes creating shielding properties.

Figure 6:
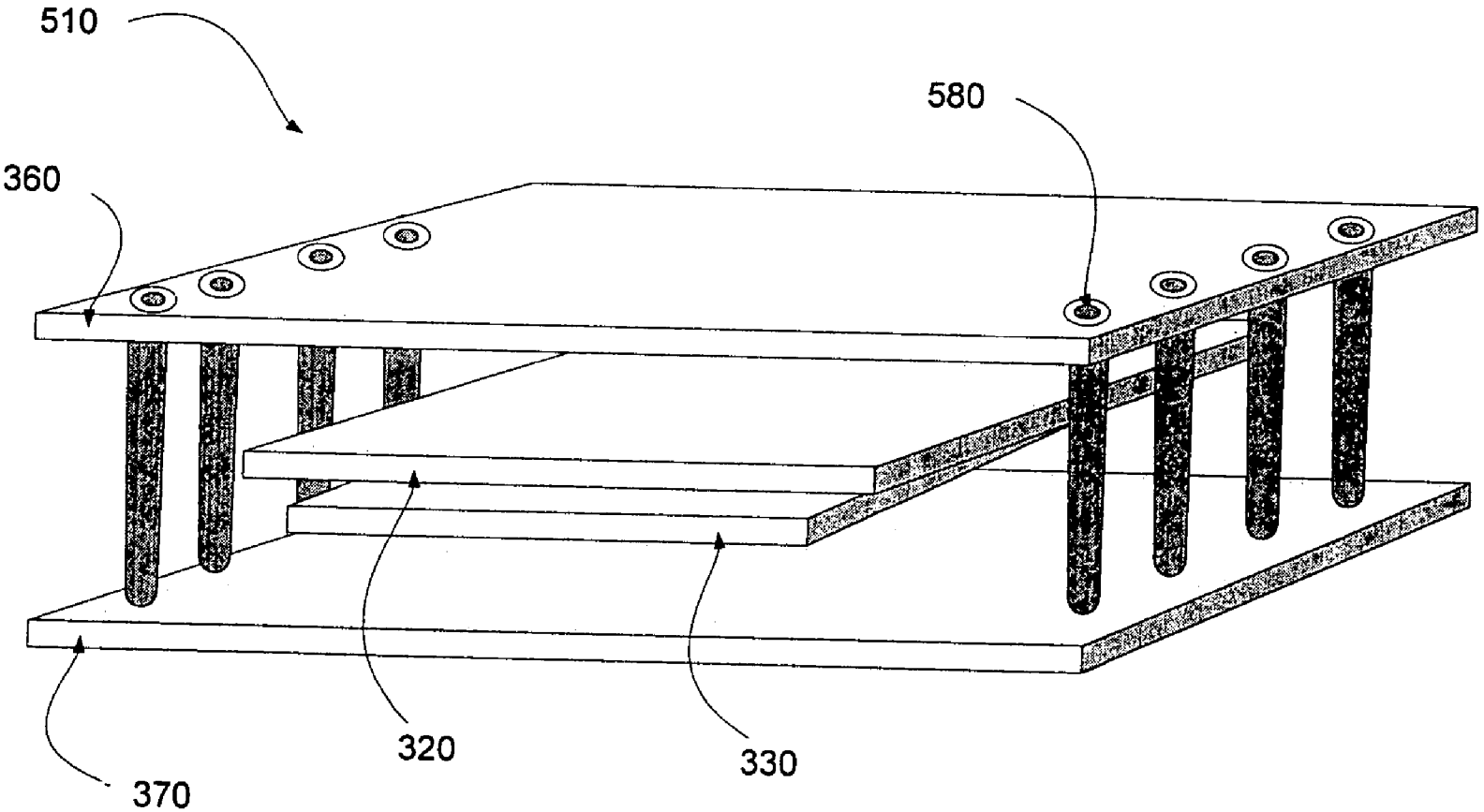
FIG. 6 shows a cross-section of the flexible wave-guide structure of the present invention.

The flexible or formable dielectric and adhesive dielectric layers in FIG. 6 are omitted for clarity, and only one section is shown, also for clarity. However, several sections are possible and anticipated as being within the scope of the present invention. The reference system can include more than one solid conductive sheet, arranged parallel to each other. The conductive sheets may also be partially filled or cross-hatched or screen-type in structure.

The widths, of the signal conductors 320, 330, may differ; depending on the single-ended load impedance requirements for the non-symmetric application. Once the single-ended parameters have been derived, the plate separation is adjusted for the odd mode impedance requirements of the balanced load. The interconnecting vias 580 placed along the edge will often include via guard traces 582 on the same layers as the signal conductors 320, 330. The via guard traces 582 are optional and associated with the method of manufacturing the partial rectangular wave-guide structure 500. One of ordinary skill in the art will recognize that the via guard traces 582 are a variation contemplated as being within the scope of the present invention. The via spacing is tailored to the desired slot aperture response characteristic according to the following equation:

$$\eta_{rs} := 20 \cdot \log\left[\frac{150}{\left(\frac{f \cdot l}{1 \cdot 10^6}\right)} \cdot \sqrt{\frac{l}{v}}\right] \qquad \text{Equation 8}$$

Where:

$\eta_{rs}$=The radiation efficiency of the slot (dB)

l=The length of the transmission line (in)

v=The via spacing (in); and f=The frequency of interest (Hz)

FIG. 6 shows a possible cross-section stack up of materials in a flexible medium. The widths of the signal conductors 320, 330 are shown unequal to accommodate a non-symmetric load.

The invention has been described with reference to two embodiments, i) a single section parallel plate wave-guide structure, and ii) a dual section parallel plate wave-guide structure. However, it will be appreciated that variations and modifications can be effected by a person of ordinary skill in the art without departing from the scope of the invention.

Parts List:

110 drive signal (FIG. 1)
120 signal conductor plate (FIGS. 1, 2)
121 drive current (FIG. 1)
122 image current (FIG. 1)
130 signal conductor plate (reference) (FIGS. 1, 2)
131 line ($Z_{in}$) (FIG. 1)
132 series loading resistor ($Z_s$) (FIG. 1)
136 transmission line impedance ($Z_{out}$) (FIG. 1)
140 dielectric material (FIG. 1)
150 load impedance (FIG. 1)
160 chassis return (FIGS. 1, 2)
280 shunt impedance (FIG. 2)
285 differential impedance (FIG. 2)
300 parallel plate wave-guide structure (FIG. 3)
305 signal source (FIG. 3)
310 signal source (FIG. 3)
320 signal conductor (FIGS. 3, 4, 5, 6)
330 signal conductor (FIGS. 3, 4, 5, 6)
340 reference-to-conductor dielectric material (FIGS. 3, 5)
341 conductor-to-conductor dielectric material (FIGS. 3, 5)
350 load (FIG. 3)
360 reference plate (FIGS. 3, 4, 5, 6)
370 reference plate (FIGS. 3, 4, 5, 6)
390 chassis return (FIG. 3)
491 shunt impedance ($Z_1$) (FIG. 4)
492 shunt impedance ($Z_2$) (FIG. 4)
493 controlled impedance ($Z_3$) (FIG. 4)
500 partial rectangular wave-guide structure (FIGS. 5, 6)
510 section of wave-guide structure 500 (FIG. 5)
520 section of wave-guide structure 500 (FIG. 5)
580 interconnecting vias (FIGS. 5, 6)
582 via guard traces (FIG. 5)

What is claimed is:

1. A parallel plate wave-guide structure in a layered medium for transmitting complementary signals, comprising:

a) at least two parallel complementary signal conductor plates, placed in substantially close proximity thereby providing coupling that favors odd mode propagation, separated by a conductor-to-conductor dielectric material, and having a controlled impedance contained between the at least two parallel complementary signal conductor plates;

b) at least two parallel reference plates forming a parallel plate reference system parallel to and surrounding the at least two parallel signal conductor plates such that a controlled impedance in relation to the parallel plate reference system and the at least two parallel complementary signal conductor plates is maintained;

c) a plurality of reference-to-conductor dielectric materials that are contained between each of the at least two parallel complementary signal conductor plates and a corresponding parallel reference plate, forming at least two independently controlled impedance paths;

d) a partial rectangular wave-guide structure comprised of the parallel plate reference system, such that each of the at least two parallel reference plates are electrically interconnected in a periodic manner;

wherein a controlled impedance path for transverse wave components traveling in the partial rectangular wave-guide structure is provided, such that dielectric paths contained within the partial rectangular wave-guide structure have identical path lengths; and wherein the partial rectangular wave-guide structure defines at least two independent propagation paths with at least two independently controlled impedance characteristics accommodate a matching requirement of a given loading characteristic.

2. The parallel plate wave-guide structure claimed in claim 1, further comprising:

a) an identical propagation path length for wave components propagating between the at least two parallel complementary signal conductor plates; and b) an identical propagation path length for transverse wave components propagating outside a signal conductor-to signal conductor dielectric path and contained in-between the at least two parallel complementary signal conductor plates and a corresponding adjacent plate of the at least two parallel reference plates.

3. The parallel plate wave-guide structure claimed in claim 1, wherein the reference-to-conductor dielectric material is a material selected from the group consisting of: gases, polymers, ceramics, liquids, and silicon substrates, wherein the material has low dielectric losses and high resistivity.

4. The parallel plate wave-guide structure claimed in claim 1, wherein the parallel plate wave-guide structure has propagation efficiencies determined by combining the at least two independent propagation paths with the at least two independently controlled impedance characteristics.

5. The parallel plate wave-guide structure claimed in claim 1, wherein the parallel plate wave-guide structure has power transfer propagation efficiencies determined by combining the at least two independent propagation paths with the at least two independently controlled impedance characteristics.

6. The parallel plate wave-guide structure claimed in claim 1, wherein the parallel plate wave-guide structure has distortion determined by combining the at least two independent propagation paths with the at least two independently controlled impedance characteristics.

7. The parallel plate wave-guide structure claimed in claim 1, wherein the conductor-to-conductor dielectric material is a material selected from the group consisting of: gases, polymers, ceramics, liquids, and silicon substrates, wherein the material has low dielectric losses and high resistivity.

8. The parallel plate wave-guide structure claimed in claim 1, wherein the partial rectangular wave-guide has semi-contiguous contact along the outside surface and edge of the parallel plate wave-guide structure such that a substantial amount of the image current is restricted from travelling outside the partial rectangular wave-guide structure.

9. The parallel plate wave-guide structure claimed in claim 1, wherein the parallel plate wave-guide structure has low radiation efficiency provided by combining the controlled paths for complementary signal components, and non-symmetric signal components due to any non-symmetry in the load and by operating below the wave-guide cutoff.

10. The parallel plate wave-guide structure claimed in claim 1, wherein the parallel plate reference system includes a plurality of solid or partially filled conductive parallel sheets and are parallel to the at least two parallel signal conductor plates that carry broadside coupled complementary signal components in the parallel plate wave-guide structure.

11. The parallel plate wave-guide structure claimed in claim 10, wherein the parallel plate reference system includes a plurality of conductive parallel plates periodically connected together by conductive vias such that the at least two parallel signal conductor plates carrying complementary signal components are contained within the partial rectangular wave-guide made up of the plurality of partially filled conductive parallel sheets and interconnecting vias.

12. A broadside-coupled transmission line system comprising:

a) a complementary signal source;

b) a parallel plate wave-guide structure including at least two signal conductor parallel plates, placed in substantially close proximity thereby providing coupling that favors odd mode propagation, separated with a conductor-to-conductor dielectric material, and at least two reference parallel plates separated from the at least two signal conductor parallel plates with a conductor-to-reference dielectric material, and electrically connected to the signal source; and c) a distributed load electrically connected to the parallel plate wave-guide structure such that power transfer is maximized by load matching;

wherein the distributed load is non-symmetric.

13. A broadside-coupled transmission line system comprising:

a) a complementary signal source;

b) a parallel plate wave-guide structure including at least two signal conductor parallel plates, placed in substantially close proximity thereby providing coupling that favors odd mode propagation, separated with a conductor-to-conductor dielectric material, and at least two reference parallel plates separated from the at least two signal conductor parallel plates with a conductor-to-reference dielectric material, and electrically connected to the signal source, wherein the parallel plate wave-guide structure provides propagation of odd transverse wave components as dominant components; and c) a distributed load electrically connected to the parallel plate wave-guide structure such that power transfer is maximized by load matching;

wherein the distributed load is substantially symmetric and currents are balanced within the parallel plate wave-guide structure, and the parallel plate wave-guide structure is free of significant chassis return currents and free of a chassis return electrical connection.

14. A broadside-coupled transmission line system, comprising:

a) a pair of complementary signal sources providing signals complementary to each other;

b) a parallel plate wave-guide structure including at least two signal conductor parallel plates, placed in substantially close proximity thereby providing coupling that favors odd mode propagation, separated with a conductor-to-conductor dielectric material, and at least two reference parallel plates separated from the at least two signal conductor parallel plates with a conductor-to-reference dielectric material, and electrically connected to the pair of complementary signal source, c) a distributed load electrically connected to the parallel plate wave-guide structure such that power transfer is maximized by load matching;

d) one of the complementary signal sources connected between one of the at least two signal conductor parallel plates and one of the at least two reference parallel plates; and e) another of the complementary signal sources connected between another of the at least two signal conductor parallel plates and another of the at least two reference parallel plates.

15. The broadside-coupled transmission line system claimed in claim 14, wherein the distributed load is non-symmetric.

16. The broadside-coupled transmission line system claimed in claim 14, further comprising:

d) an electrically connected chassis return between one of the complementary signal sources and the distributed load.

17. The broadside-coupled transmission line system claimed in claim 14, wherein the distributed load is substantially symmetric and currents are balanced within the parallel plate wave-guide structure.

18. The broadside-coupled transmission line system claimed in claim 17, wherein the parallel plate wave-guide structure is free of significant chassis return currents and free of a chassis return electrical connection.

* * * * *